US010979811B2

(12) United States Patent
Warner et al.

(10) Patent No.: US 10,979,811 B2
(45) **Date of Patent: *Apr. 13, 2021**

(54) CENTER PROTECTION DYNAMIC RANGE CONTROL

(71) Applicant: DTS, Inc., Calabasas, CA (US)

(72) Inventors: Aaron Kube Warner, Seattle, WA (US); Daekyoung Noh, Huntington Beach, CA (US); Michael Johns, San Juan Capistrano, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/738,252

(22) Filed: Jan. 9, 2020

(65) Prior Publication Data

US 2020/0154206 A1 May 14, 2020

Related U.S. Application Data

(63) Continuation of application No. 16/369,205, filed on Mar. 29, 2019, now Pat. No. 10,567,878.

(60) Provisional application No. 62/650,206, filed on Mar. 29, 2018.

(51) Int. Cl.

| | |
|---|---|
| ***H04R 5/02*** | (2006.01) |
| ***G10L 19/008*** | (2013.01) |
| ***H04S 7/00*** | (2006.01) |
| ***H04R 5/00*** | (2006.01) |

(52) U.S. Cl.

CPC ..... *H04R 5/02* (2013.01); *G10L 19/008* (2013.01); *H04R 5/00* (2013.01); *H04R 2430/01* (2013.01);

(Continued)

(58) Field of Classification Search

CPC ..... H04R 5/02; H04R 5/00; H04R 2430/01; G10L 19/008; H04S 7/00; H04S 7/30;

(Continued)

(56) References Cited

U.S. PATENT DOCUMENTS 10,567,878 B2 * 2/2020 Warner ..... H04R 5/02
2008/0049943 A1 2/2008 Faller et al.

(Continued)

FOREIGN PATENT DOCUMENTS

WO WO-2019191611 A1 10/2019

OTHER PUBLICATIONS

"U.S. Appl. No. 16/369,205, Notice of Allowance dated Oct. 17, 2019", 11 pgs.

(Continued)

*Primary Examiner* — Andrew L Sniezek

(74) *Attorney, Agent, or Firm* — Schwegman Lundberg & Woessner, P.A.

(57) ABSTRACT

Circuitry can separate a multi-channel input signal into a center signal and a residual signal, apply time-varying center and residual gains to the center and residual signals, and combine the gain-adjusted center and residual signals to form a multi-channel audio signal. The center and residual gains are automatically determined in response to the center and residual signals so as to prevent each channel of the multi-channel audio signal from exceeding a target volume. During first times, the center and residual gains can vary synchronously so as to ensure that amplitude and phase relationships among channels in the multi-channel input signal are retained into the multi-channel audio signal. During second times, the center and residual gains can vary independently so as to reduce the energy of the residual signal compared to the center signal in the multi-channel audio signal.

20 Claims, 11 Drawing Sheets

(52) U.S. Cl.
CPC . *H04S 7/00* (2013.01); *H04S 7/30* (2013.01); *H04S 7/307* (2013.01); *H04S 2400/01* (2013.01); *H04S 2400/05* (2013.01)

(58) Field of Classification Search
CPC ... H04S 7/307; H04S 2400/01; H04S 2400/05
See application file for complete search history.

(56) References Cited

U.S. PATENT DOCUMENTS

| | | | | |
|---|---|---|---|---|
| 2008/0159544 | A1* | 7/2008 | Kim | H04S 3/00 381/1 |
| 2012/0170756 | A1 | 7/2012 | Kraemer et al. | |
| 2013/0121411 | A1 | 5/2013 | Robillard et al. | |
| 2017/0154636 | A1 | 6/2017 | Geiger et al. | |
| 2019/0306626 | A1 | 10/2019 | Warner et al. | |

OTHER PUBLICATIONS

"International Application Serial No. PCT/US2019/024876, International Search Report dated Jul. 30, 2019", 4 pgs.
"International Application Serial No. PCT/US2019/024876, Invitation to Pay Additional Fees dated Jun. 7, 2019", 2 pgs.
"International Application Serial No. PCT/US2019/024876, Written Opinion dated Jul. 30, 2019", 6 pgs.
"International Application Serial No. PCT/US2019/024876, International Preliminary Report on Patentability dated Oct. 8, 2020", 8 pgs.

* cited by examiner

CENTER PROTECTION DYNAMIC RANGE CONTROL

CROSS-REFERENCE TO RELATED APPLICATION

This application is a Continuation of U.S. patent application Ser. No. 16/369,205, filed Mar. 29, 2019, which claims the benefit of U.S. Provisional Application Ser. No. 62/650,206, filed Mar. 29, 2018, both of which are hereby incorporated by reference in their entireties.

FIELD OF THE DISCLOSURE

The technology described in this document relates generally to dynamic range control in multi-channel audio.

BACKGROUND OF THE DISCLOSURE

In this document, dynamic range control refers to a class of dynamic range processors such as a limiter, a compressor, and/or processors. When an input signal is below a threshold, the limiter, compressor, and/or processors produce an output signal having a linear relationship to the input signal. When the input signal exceeds a threshold, the limiter, compressor, and/or processors apply a time varying gain to the input signal to achieve a dynamic range goal for the output signal.

There are many instances when it can be desirable to reduce a dynamic range of an audio signal, such as by dynamic range compression, limiting, or a combination of the two, often referred to as compression/limiting.

Such dynamic range reduction can be useful for digital audio systems. Most digital system have a fixed maximum peak volume, denoted by 100%. As an example, if the volume of a musical piece is reduced overall so that a particularly loud portion does not clip (e.g., exceed 100% of the maximum volume level of the digital audio system), then softer portions of the musical piece may be inaudible or difficult to hear. Dynamically reducing the volume of just the loud portion, but not the softer portions, can allow the overall volume of the musical piece to be raised to a more reasonable level, which can improve listening in a noisy environment, such as an automobile.

Such dynamic range reduction can also be useful for analog audio systems. For example, phonograph records are subject to mechanical constraints that dictate how loud the recorded levels can be, where a portion that is too loud can cause the phonograph needle to skip. Reducing the overall volume of the material on the record can be unsatisfactory, because the softer material can get lost in a surface noise floor from the record. Dynamically reducing the volume of just the loud portions of the material, but not the softer portions, can allow the overall volume of the musical piece to be raised to a more reasonable level so that it is well above the noise floor of the record.

Dynamic range reduction is straightforward for a single-channel audio signal, such as a live feed from a microphone or instrument, or a monaural (mono) recording from the pre-stereo era. Compressor/limiters are readily available for single-channel inputs and single-channel outputs.

However, dynamic range reduction is significantly more complicated for a multi-channel audio signal, such as a stereo audio signal, especially when coupled with spatial enhancement processing, such as widening the soundstage of the stereo audio signal. In some examples, the dynamic range reduction can introduce volume-related and/or panning-related artifacts into the multi-channel audio signal.

Accordingly, there exists a need for audio processing that can apply dynamic range reduction for a multi-channel audio signal, without introducing volume-related and/or panning-related artifacts into the multi-channel audio signal.

BRIEF DESCRIPTION OF THE DRAWINGS

Corresponding reference characters indicate corresponding parts throughout the several views. Elements in the drawings are not necessarily drawn to scale. The configurations shown in the drawings are merely examples, and should not be construed as limiting the scope in any manner.

DETAILED DESCRIPTION

Circuitry can separate a multi-channel input signal into a center signal and a residual signal, apply time-varying center and residual gains to the center and residual signals, and combine the gain-adjusted center and residual signals to form a multi-channel audio signal. The center and residual gains are automatically determined in response to the center and residual signals so as to prevent each channel of the multi-channel audio signal from exceeding a target volume. During first times, the center and residual gains can vary synchronously so as to ensure that amplitude and phase relationships among channels in the multi-channel input signal are retained into the multi-channel audio signal. During second times, the center and residual gains can vary independently so as to reduce the energy of the residual signal compared to the center signal in the multi-channel audio signal.

It is instructive to consider a specific example that shows the difficulty in applying dynamic range control to a stereo signal. Specifically, the example of FIGS. 1-2 exhibits pumping or breathing artifacts caused by out-of-phase content triggering limiting of in-phase content.

Figure 1:
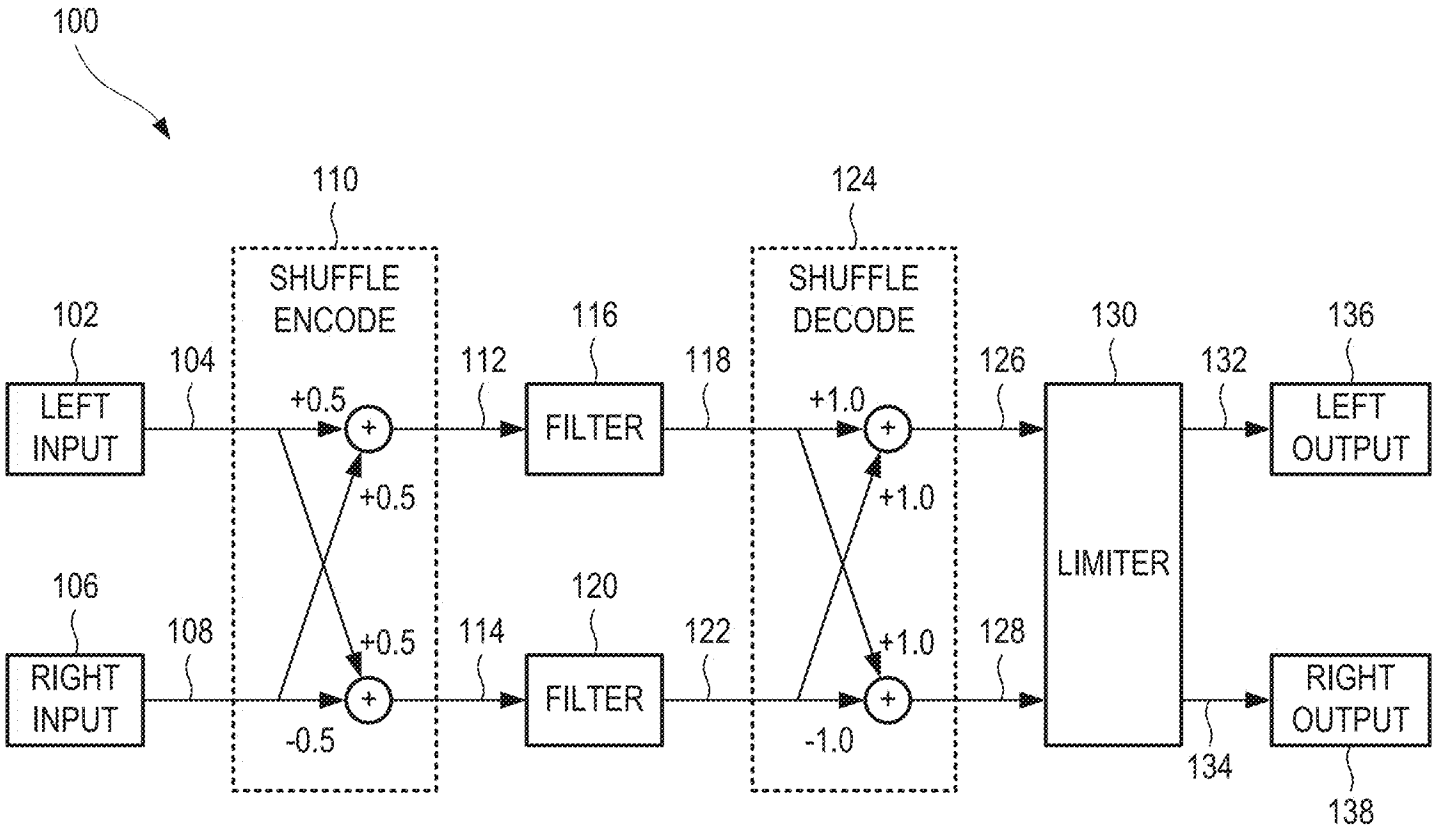
FIG. 1 shows an example of a system having a virtualizer topology in which the sum and difference signals are independently filtered, in accordance with some embodiments.

FIG. 1 shows an example of a system 100 having a virtualizer topology in which the sum and difference signals are independently filtered, in accordance with some embodiments. A system such as 100 can perform tasks such as spatial enhancement, which can widen or reduce a soundstage of a two-channel (stereo) signal, among other tasks.

The system 100 can have a left input 102 that can electrically connect to a signal source to receive a left input signal 104, and a right input 106 that can electrically connect to a signal source to receive a right input signal 108. The input and output signals discussed in this document can be analog, digital, or a combination of analog and digital.

The system 100 can employ shufflers to switch between left/right signals and sum/difference signals. An encoder shuffler 110 can sum the left input signal 104 and the right input signal 108 to form a sum signal 112, which can be written as L+R. In this example, the encoder shuffler 110 can divide both the left input signal 104 and the right input signal 108 by two before summing. In other examples, a downstream decoder shuffler can include the dividing by two, or both shufflers can include factors of $2^{-1/2}$. The encoder shuffler 110 can subtract the right input signal 108 from the left input signal 104 to form a difference signal 114, written as L−R. In this example, the encoder shuffler 110 can divide both the left input signal 104 and the right input signal 108 by two before forming the difference. In other examples, a downstream decoder shuffler 124 can include the dividing by two, or both shufflers can include factors of $2^{-1/2}$. The downstream decoder shuffler, as well as other shufflers discussed below, operate in a matter similar to the encoder shuffler 110, where the factor of two can be applied at encoding, decoding, or split between encoding and decoding in any suitable manner.

The system 100 can apply a sum signal filter 116 to the sum signal 112 to form a filtered sum signal 118. The sum signal filter 116 can be any suitable type of filter, including, but not limited to, a gain filter that applies a volume change (up or down) for all frequencies, a frequency-specific gain filter that applies a volume change that varies as a function of frequency (such as a bass boost, a treble cut, a notch filter to remove hum at a specified frequency, and so forth), a time-varying gain filter, and others.

Similarly, the system 100 can apply a difference signal filter 120 to the difference signal 114 to form a filtered difference signal 122. The difference signal filter 120 can also be any suitable type of filter, and can typically be the same type of filter as the sum signal filter 116, but operating with different parameters than the sum signal filter 116. For example, if the system 100 is designed to enhance the spatial characteristics of the soundstage, such as by widening the soundstage, the system 100 can apply more gain (or less attenuation) at the difference signal filter 120 than at the sum signal filter 116. The effects of such soundstage widening is that out-of-phase elements are emphasized with respect to the in-phase elements. In a specific example of a music mix, if a lead vocal is centered (e.g., having equal volumes in the left and right channels that vary synchronously), a guitar part is panned slightly left, and a bass part is panned slightly right, the filtering can exaggerate the panning of the guitar and bass parts, with respect to the centered vocals.

A decoder shuffler 124 can sum the filtered sum signal 118 (L+R) and the filtered difference signal 122 (L−R) to form a filtered left signal 126, written as L'. The decoder shuffler 124 can subtract the filtered difference signal 122 (L−R) from the filtered sum signal 118 (L+R) to form a filtered right signal 128, written as R'. The decoder shuffler 124 can account for the factor of two in concert with the encoder shuffler 110, as explained above, so that nominally, for the case in which the filter simply applies a gain of unity for all frequencies, the filtered left signal 126 exactly matches the left input signal 104, and the filtered right signal 128 exactly matches the right input signal 108.

Figure 2:
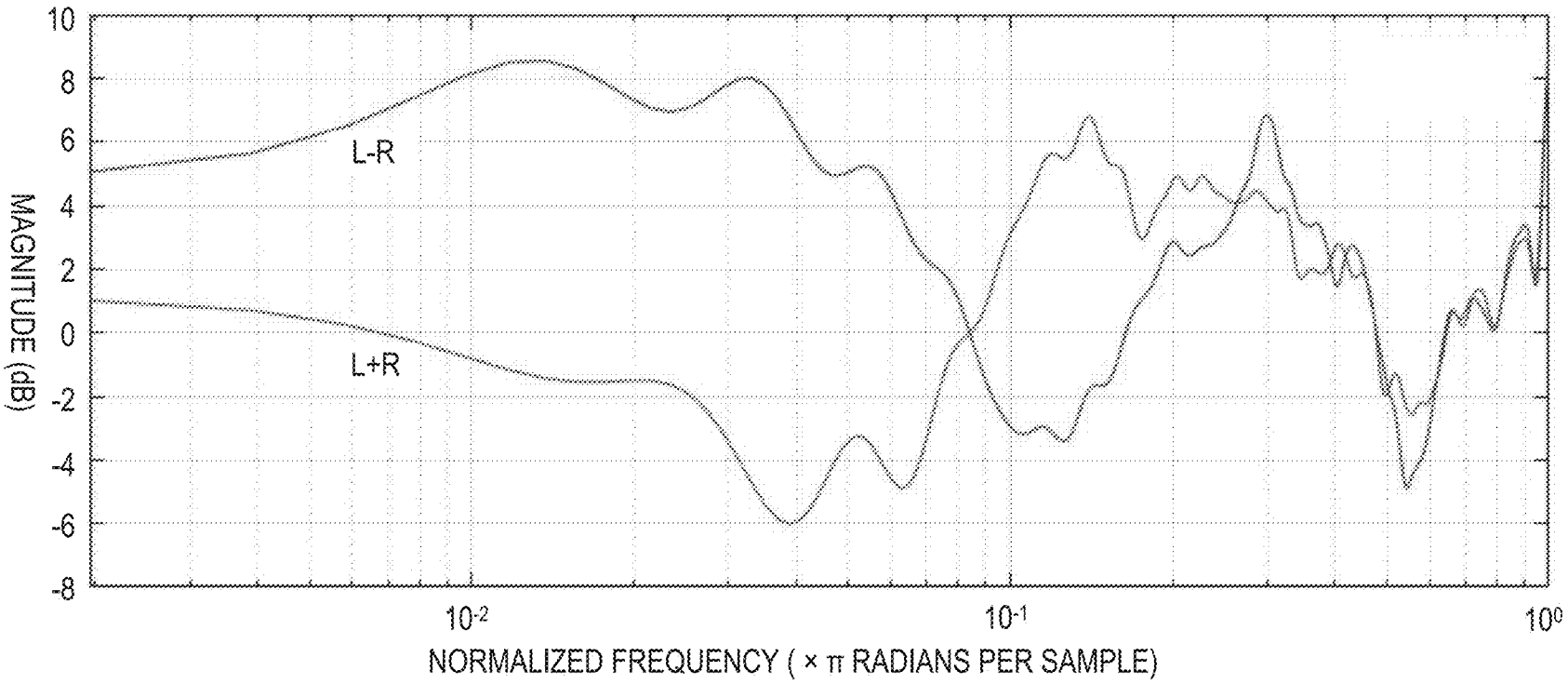
FIG. 2, which shows an example of gain magnitudes applied by the sum signal filter and the difference signal filter, as a function of frequency, in accordance with some embodiments.

We turn momentarily to FIG. 2, which shows an example of gain magnitudes applied by the sum signal filter 116 ("L+R") and the difference signal filter 120 ("L−R"), as a function of frequency, in accordance with some embodiments. At relatively low frequencies ("bass"), the low-frequency content is typically centered between the left and right channels (e.g., the bass can be mixed to mono), so that the in-phase content can be significantly larger than the out-of-phase content at low frequencies, and the sum signal 112 can be much larger than difference signal 114 at low frequencies. At relatively high frequencies ("treble"), the high-frequency content can be more evenly split between in-phase and out-of-phase, so that the sum signal 112 can be comparable to the difference signal 114 at high frequencies.

As a result, boosting the out-of-phase content at the difference signal filter 120, which can desirably widen the soundstage of the stereo audio signal, can undesirably cause the filtered left signal 126 and/or the filtered right signal 128 to intermittently exceed 100% (e.g., exceed a digital maximum volume level) or exceed a target volume level (which can be a specified level less than or equal to 100%).

Returning to FIG. 1, a limiter 130 can temporarily reduce the volume of the filtered left signal 126 and the filtered right signal 128, together, for time intervals in which the filtered left signal 126 and/or the filtered right signal 128 exceeds 100%. The limiter 130 can apply a temporary volume drop to the filtered left signal 126 to form a limited filtered left signal 132, and can apply the same temporary volume drop (e.g., a volume drop having the same magnitude and temporal profile) to the filtered right signal 128 to form a limited filtered right signal 134. The limited filtered left signal 132 can form a left output 136 of the system 100. The limited filtered right signal 134 can form a right output 138 of the system 100. In some examples, the left output 136 and the right output 138 can be sent to speakers or headphones, to produce audio corresponding to the outputs. In some examples, the outputs can be recorded, for use at a later time. In some examples, the outputs can be further processed downstream.

In general, it is beneficial to apply the same limiting to the left and right channels, to avoid panning artifacts in the left output 136 and the right output 138, where instruments would appear to temporarily shift in the soundstage when the limiting is applied. Because the same degree of limiting is applied to the left and right channels, the limiting is referred to as "linked" between the left and right channels.

An artifact of using the system 100 of FIG. 1 is that having a relatively high out-of-phase content, with respect to the in-phase content, can produce limiting of the left output 136 and the right output 138, which can include undesirable limiting of the in-phase content. For example, a long, sustained piano note, centered in the mix, can experience an undesirable drop in volume when the system 100 compensates for an out-of-phase burst of sound, such as a panned guitar solo. These undesirable drops in volume can be referred to as "pumping" or "breathing" artifacts. The systems and methods discussed in detail below can reduce or eliminate the pumping or breathing artifacts caused by out-of-phase content triggering limiting of in-phase content.

Before specifically addressing reduction or elimination of the pumping or breathing artifacts caused by out-of-phase content triggering limiting of in-phase content, it is instructive to first describe at a high level general dynamic range control system. The general dynamic range control system includes elements that can be modified as needed to address the pumping or breathing artifacts discussed above.

Figure 3:
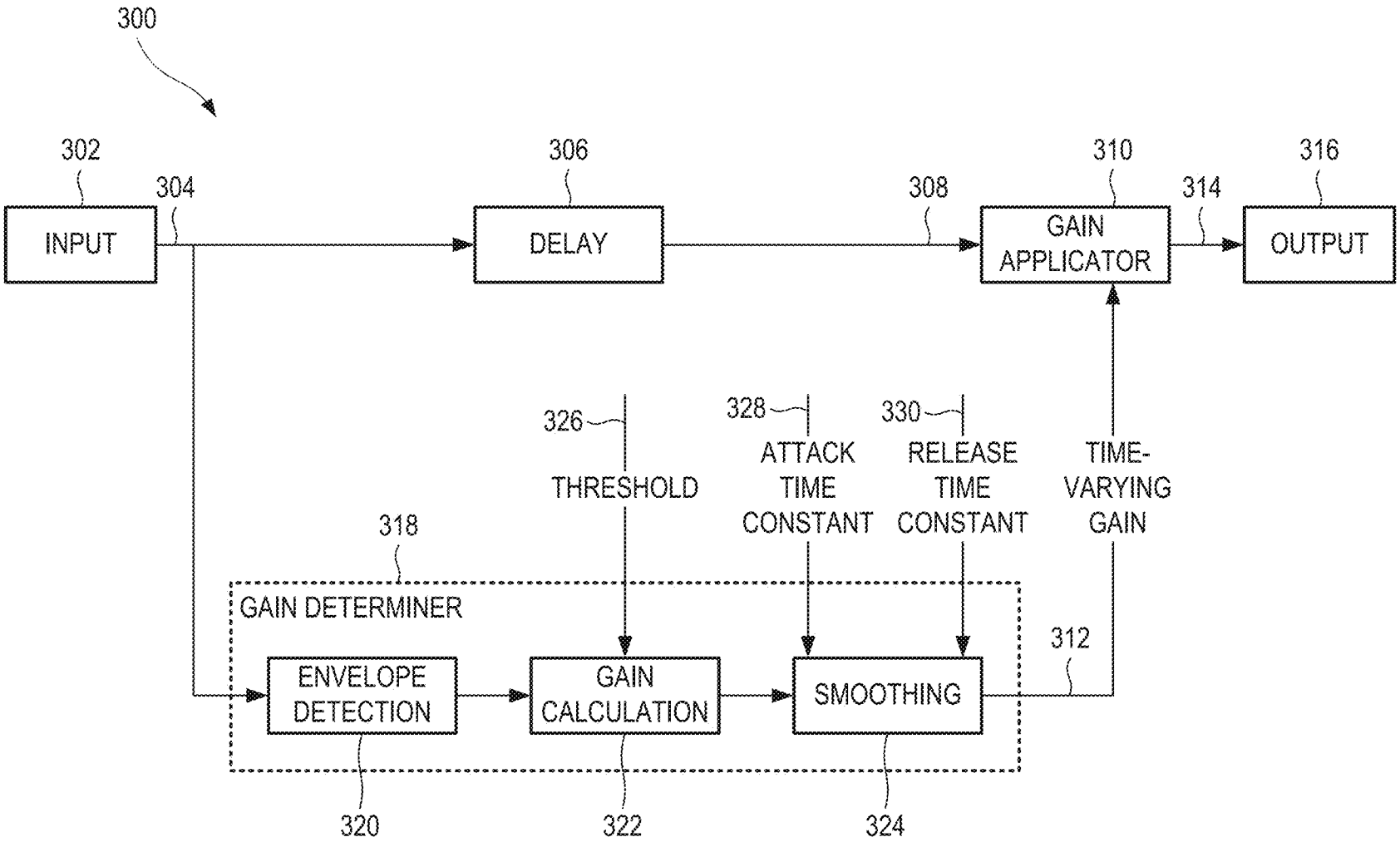
FIG. 3 shows an example of a general dynamic range control system, in accordance with some embodiments.

FIG. 3 shows an example of a general dynamic range control system 300, in accordance with some embodiments. The general dynamic range control system 300 can be configured as a compressor, a limiter, an expander, or another suitable configuration that can affect the dynamic range of an audio signal. The general dynamic range control system 300 can include all analog components, one or more analog components among other digital components, one or more digital components among other analog components, or entirely digital components. The components of the general dynamic range control system 300 can be configured as all hardware (e.g., hard-wired circuitry), all software (e.g., instructions stored in memory to be executed by a processor having circuitry), or a combination of hardware and software.

The system 300 can have an input 302 that can electrically connect to a signal source to receive one or more input signals 304. The input and output signals discussed in this document can be analog, digital, or a combination of analog and digital. The one or more input signals 304 can be a single signal, such as for a mono source, a pair of input signal, such as for a stereo source, or more than two input signals, such as for a multi-channel source.

The general dynamic range control system 300 can operate over a specified sliding time interval, so that the system can respond quickly, but typically not instantaneously, to sudden changes in volume that can cause the one or more input signals 304 to exceed a specified threshold. To allow the system 300 to look ahead at upcoming frames of audio, the system 300 can include a delay 306. The delay 306 can have a fixed value, which can correspond to the sliding time interval over which the system 300 operates. The delay 306 can receive the one or more input signals 304, delay the signals in a suitable buffer (or a suitable analog device, such as a tape loop), and produce one or more delayed input signals 308.

A gain applicator 310 can apply a time-varying gain 312 to the one or more delayed input signals 308 to produce one or more output signals 314. The system 300 can direct the one or more output signals 314 to an output 316 of the system 300.

A gain determiner 318 can dynamically determine the time-varying gain 312, as a function of the one or more input signals 304, and as a function of one or more specified parameters (discussed below). For example, if the gain determiner 318 sees a particularly loud portion in an upcoming frame of the one or more input signals 304, the gain determiner 318 can set the time-varying gain 312 to a suitably low value at that frame, to reduce the volume of the loud portion in the one or more output signals 314 when the gain is applied.

The gain determiner 318 can perform three tasks, referred to as envelope detection 320, gain calculation 322, and smoothing 324. Envelope detection 320 can be performed first, with the gain calculation 322 either preceding or following the smoothing 324.

For envelope detection 320, the gain determiner 318 can determine a time-varying volume level for a particular group of samples within the one or more input signals 304. In some examples, the envelope detection 320 can include peak level detection (e.g., returning a maximum signal level, for all the samples within the group of samples). In other examples, the envelope detection 320 can include root-mean-square (RMS) level detection, which can correspond to an average signal energy within the group of samples. Other ways to determine the envelope of the one or more input signals 304 can also be used.

For gain calculation 322, the gain determiner 318 can determine what gain should be applied to a group of samples such that after the gain is applied, the envelope of the samples (determined at 320) does not exceed a specified threshold 326. In some examples, a user can specify the specified threshold 326. In some examples, the specified threshold 326 can be static. In some example, the gain calculation 322 can determine a short-term gain required to fully correct the input signal envelope to a linear threshold level. In some examples, the gain determiner 318 can be used in the context of a limiter. In other examples, the gain determiner 318 can be used in the context of a compressor, or another suitable audio processing technique.

One linear example of a gain calculation 322 is as follows. If the envelope of a sample (determined at 320) is less than the specified threshold 326, then the gain for that sample can be unity. If the envelope of the sample is greater than the threshold 326, then the gain for that sample can be the threshold 326, divided by the linear envelope (determined at 320).

In general, the determined gain should not be applied on a sample-by-sample basis, because doing so could cause overflow, or clipping some peaks in the waveform of the audio signal, and instead produce a flat waveform with a level of the threshold 326 replacing the peaks. This is undesirable. To reduce or avoid undesirable audible distortions in the audio, the gain determiner 318 can use smoothing 324 to ensure that the determined gain can be applied in a gradual manner (e.g., easing in or easing out the applied gain over time.)

The smoothing 324 can use two user-specified values to specify how to apply the determined gain (determined at 322). An attack time constant 328 can determine how quickly to apply the determined gain. A release time constant 330 can determine how quickly the applied gain fades, after it has been applied.

One example of smoothing 324 employs an asymmetrical exponential moving average, as follows:

$$g'(m) = \begin{cases} (1-\alpha)g'(m-1) + \alpha g(m), & \text{if } g(m) < g'(m-1) \\ (1-\beta)g'(m-1) + \beta g(m), & \text{otherwise} \end{cases}$$

where quantity represents a particular sample or range of samples, quantity g(m) is the determined gain (determined at 322) for sample m, quantity g'(m) is the smoothed gain for sample m, quantity $\alpha$ is the attack time constant 328, and quantity $\beta$ is the release time constant 330. Other smoothing schemes can also be used. In some examples, the time constants can be static and user-defined, so that they do not vary until a user redefines them.

For the case of stereo, with the input signals 304 including a left input signal and a right input signal, the time-varying gain 312 can be applied at 310, equally, to both the left and right input signals. Applying the gain equally to the left and right channels is generally beneficial, because it does not alter the soundstage when the gain is applied. For example, a guitar panned to a particular location in the soundstage would not drift toward the left or the right when the gain is applied, if the gain is applied equally to the left and right channels. Applying the gain simultaneously to two or more channels in the audio signals is referred to as linking the dynamic range control system 300.

The systems discussed in detail below can advantageously maintain the beneficial characteristics of a fully linked dynamic range control system, preserve the subjective envelope of center panned audio, and independently prevent spatial audio from resulting in output levels that exceed the limits of the listening device. Unfortunately, this can result in lessening the effectiveness of spatial enhancements, at louder listening levels, but this is an acceptable tradeoff.

Figure 4:
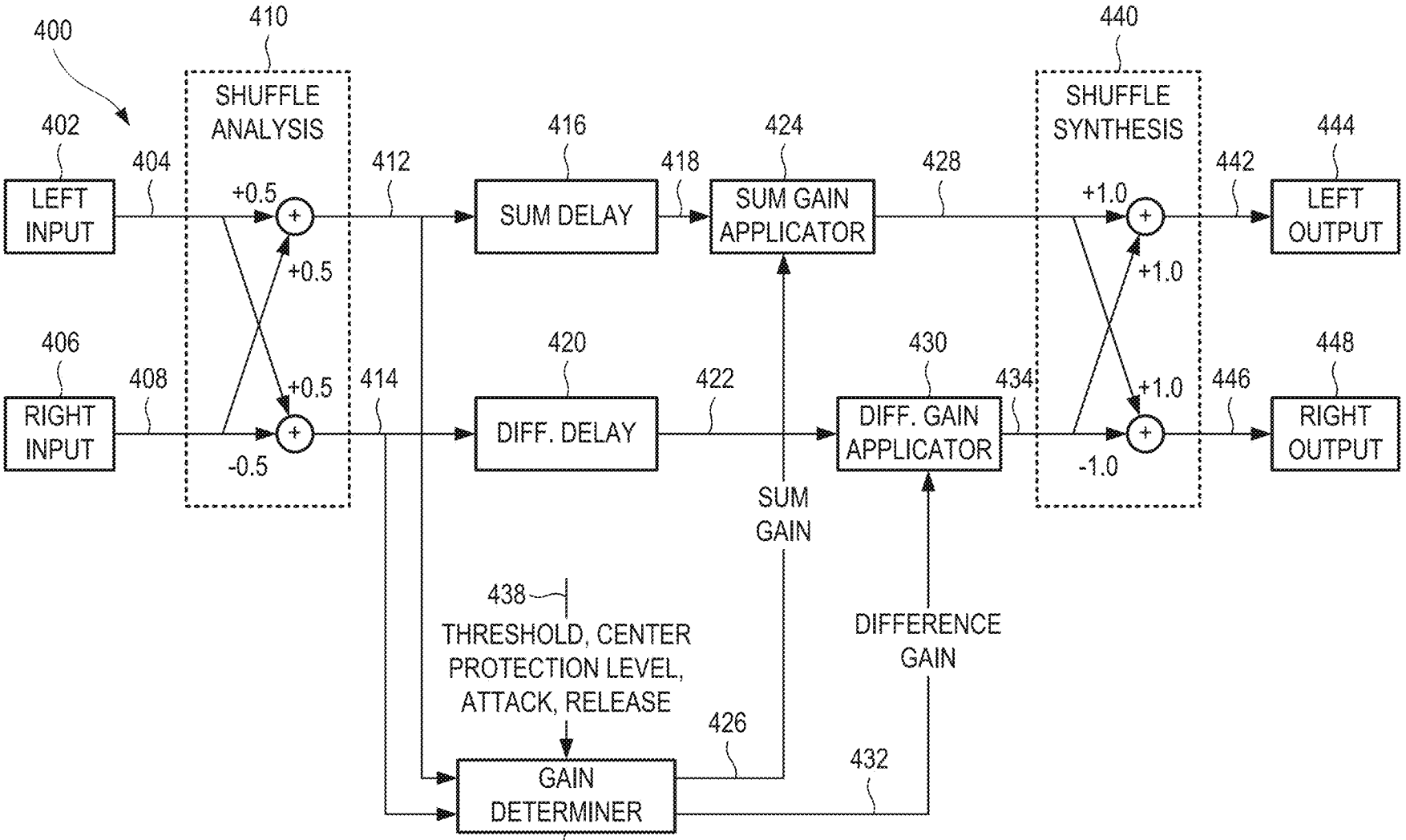
FIG. 4 shows an example of a dynamic range control system in which a shuffler topology can transform left/right signals into sum/difference signals and back to left/right signals, in accordance with some embodiments.

FIG. 4 shows an example of a dynamic range control system 400 in which a shuffler topology can transform left/right signals into sum/difference signals and back to left/right signals, in accordance with some embodiments. A sum gain can be applied to the sum signal, and an optionally different difference gain can be applied to the difference signal.

The system 400 can have a left input 402 that can electrically connect to a signal source to receive a left input signal 404, and a right input 406 that can electrically connect to a signal source to receive a right input signal 408. The input and output signals discussed in this document can be analog, digital, or a combination of analog and digital.

The system 400 can employ shufflers to switch between left/right signals and mid (or sum) and side (or difference) signals. An analyzer shuffler 410 can sum the left input signal 404 and the right input signal 408 to form a sum signal 412, which can be written as L+R. In this example, the analyzer shuffler 410 can divide both the left input signal 404 and the right input signal 408 by two before summing. In other examples, a downstream synthesizer shuffler can include the dividing by two, or both shufflers can include factors of $2^{-1/2}$. The analyzer shuffler 410 can subtract the right input signal 408 from the left input signal 404 to form a difference signal 414, written as L−R. In this example, the analyzer shuffler 410 can divide both the left input signal 404 and the right input signal 408 by two before forming the difference. In other examples, a downstream synthesizer shuffler can include the dividing by two, or both shufflers can include factors of $2^{-1/2}$. The downstream synthesizer shuffler, as well as other shufflers discussed below, operate in a matter similar to the analyzer shuffler 410, where the factor of two can be applied at encoding, decoding, or split between encoding and decoding in any suitable manner.

To allow the system 400 to look ahead at upcoming frames of audio, the system 400 can include a sum channel delay 416 that can delay the sum signal 412 to form a delayed sum signal 418. Similarly, a difference channel delay 420 can delay the difference signal 414 to form a delayed difference signal 422. The sum channel delay 416 and the difference channel delay 420 can delay their respective signals by the same time interval (e.g., the same number of samples or frames.)

A sum gain applicator 424 can apply a time-varying sum gain 426 to the delayed sum signal 418 to produce a limited delayed sum signal 428. Similarly, a difference gain applicator 430 can apply a time-varying difference gain 432 to the delayed difference signal 422 to produce a limited delayed difference signal 434.

A gain determiner 436 can determine the time-varying sum gain 426 and the time-varying difference gain 432, in response to the sum signal 412 and the difference signal 414, and in response to user-specified parameters 438, such as a threshold, an attack time constant, a release time constant, and a center protection level. The gain determiner 436 is discussed in detail below.

A synthesizer shuffler 440 can sum the limited delayed sum signal 428 and the limited delayed difference signal 434 to form a left output signal 442. The left output signal 442 can form a left output 444 of the system 400. The synthesizer shuffler 440 can subtract the limited delayed difference signal 434 from the limited delayed sum signal 428 to form a right output signal 446. The right output signal 446 can form a right output 448 of the system 400.

Figure 5:
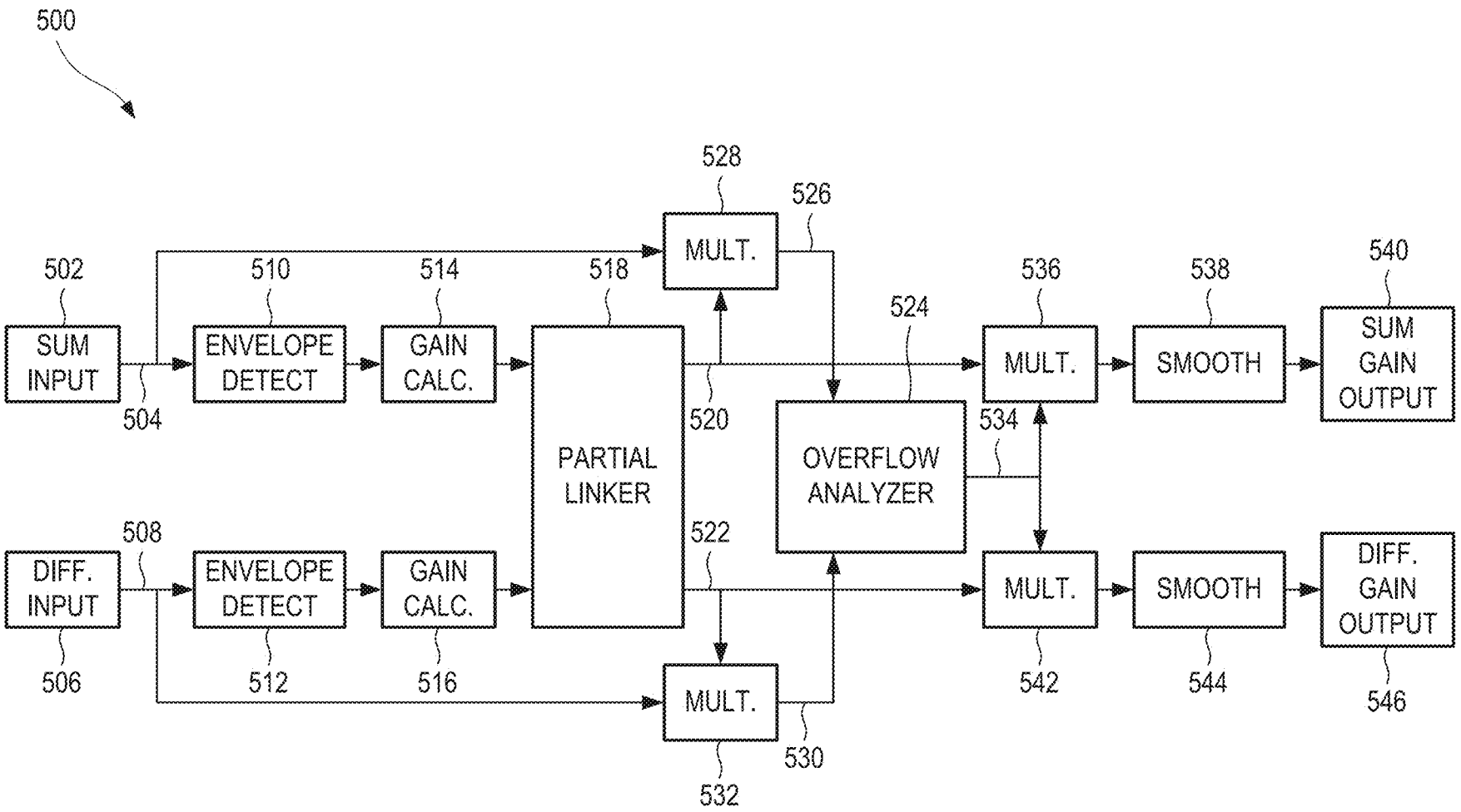
FIG. 5 shows an example of a gain determiner, in accordance with some embodiments.

FIG. 5 shows an example of a gain determiner 500, in accordance with some embodiments. The gain determiner 500 of FIG. 5 is suitable for use in the dynamic range control system 400 of FIG. 4, and for other systems. The gain determiner 500 of FIG. 5 is but one example of a gain determiner; other suitable configurations can also be used.

The gain determiner 500 can automatically determine the time-varying center gain and the time-varying residual gain in response to the center signal and the residual signal, so as to prevent the left output signal and the right output signal from exceeding a target volume (such as 100% or a specified target value less than or equal to 100%). The time-varying center gain can vary synchronously with the time-varying residual gain (e.g., having identical values as the gains vary over time, or having values that differ by a constant multiplicative factor as the gains vary over time) during at least first times so as to ensure that amplitude and phase relationships among channels in the multi-channel input signal are retained into the multi-channel audio signal during the first times. The time-varying center gain can vary independently of the time-varying residual gain during at least second times so as to reduce the energy of the residual signal compared to the center signal in the multi-channel audio signal during the second times.

Compared with the gain determiner 318 of FIG. 3, the gain determiner 500 additionally includes a partial linker, which can preserve the panning of center-panned elements in the audio signals, and an overflow analyzer, which can ensure that after the left and right signals are recreated from the sum and difference signals, the left and right signals do not exceed a specified threshold. These additional elements are discussed briefly below with regard to FIG. 5, and explained in more detail with regard to FIGS. 6 and 7.

The gain determiner 500 receives as input 502 a sum signal 504, such as the sum signal 412 shown in FIG. 4. The gain determiner 500 also receives as input 506 a difference signal 508, such as the difference signal 414 shown in FIG. 4.

A sum envelope detector 510, similar in operation to the envelope detection 320 in FIG. 3, can determine a time-varying volume level for the sum signal 504. A difference envelope detector 512, also similar in operation to the envelope detection 320 in FIG. 3, can determine a time-varying volume level for the difference signal 508. The sum envelope detector 510 and the difference envelope detector 512 can produce time-varying values of volume level, through peak level detection, RMS level detector, or another suitable measurement technique.

A sum gain calculator 514, similar in operation to the gain calculation 322 in FIG. 3, can receive the time-varying value of volume level of the sum signal 504 from the sum envelope detector 510, and can determine what gain should be applied to a group of samples in the sum signal 504 such that after the gain is applied, the sum envelope of the samples (determined at 510) does not exceed a specified threshold. In some examples, a user can specify the specified threshold.

A difference gain calculator 516, also similar in operation to the gain calculation 322 in FIG. 3, can receive the time-varying value of volume level of the difference signal 508 from the difference envelope detector 512, and can determine what gain should be applied to a group of samples in the difference signal 508 such that after the gain is applied, the difference envelope of the samples (determined at 512) does not exceed a specified threshold, optionally the same threshold as used in the sum gain calculator 514.

The gain determiner 500 of FIG. 5 includes additional elements, compared to the gain determiner 318 of FIG. 3.

A first additional element is a partial linker 518, which can preserve the panning of center-panned elements in the audio signals. An example of a partial linker is provided in FIG. 6 and is discussed in detail below. The partial linker 518 receives as input the sum gain from the sum gain calculator 514 and the difference gain from the difference gain calculator 516. The partial linker 518 links the sum gain and the difference gain, to a degree that can optionally be specified by a user, to form a partially linked sum gain 520 and a partially linked difference gain 522.

A second additional element is an overflow analyzer 524, which can ensure that after the left and right signals are recreated from the sum and difference signals, the left and right signals do not exceed a specified threshold, such as 100%. An example of an overflow analyzer is provided in FIG. 7 and is discussed in detail below. The overflow analyzer 524 receives as input a provisional sum signal 526, which is the sum signal 504 multiplied (at 528) by the partially linked sum gain 520, and a provisional difference signal 530, which is the difference signal 508 multiplied (at 532) by the partially linked difference gain 522. The overflow analyzer 524 can form as its output an overflow gain 534.

The partially linked sum gain 520 can be multiplied (at 536) by the overflow gain 534, and smoothed at 538 (similar to 324 of FIG. 3) to form a sum gain output 540. The sum gain output 540 is one output of the gain determiner 500, comparable to the sum gain 426 of FIG. 4.

The partially linked difference gain 522 can be multiplied (at 542) by the overflow gain 534, and smoothed at 544 (similar to 324 of FIG. 3) to form a difference gain output 546. The difference gain output 546 is the other output of the gain determiner 500, comparable to the difference gain 432 of FIG. 4.

Figure 6:
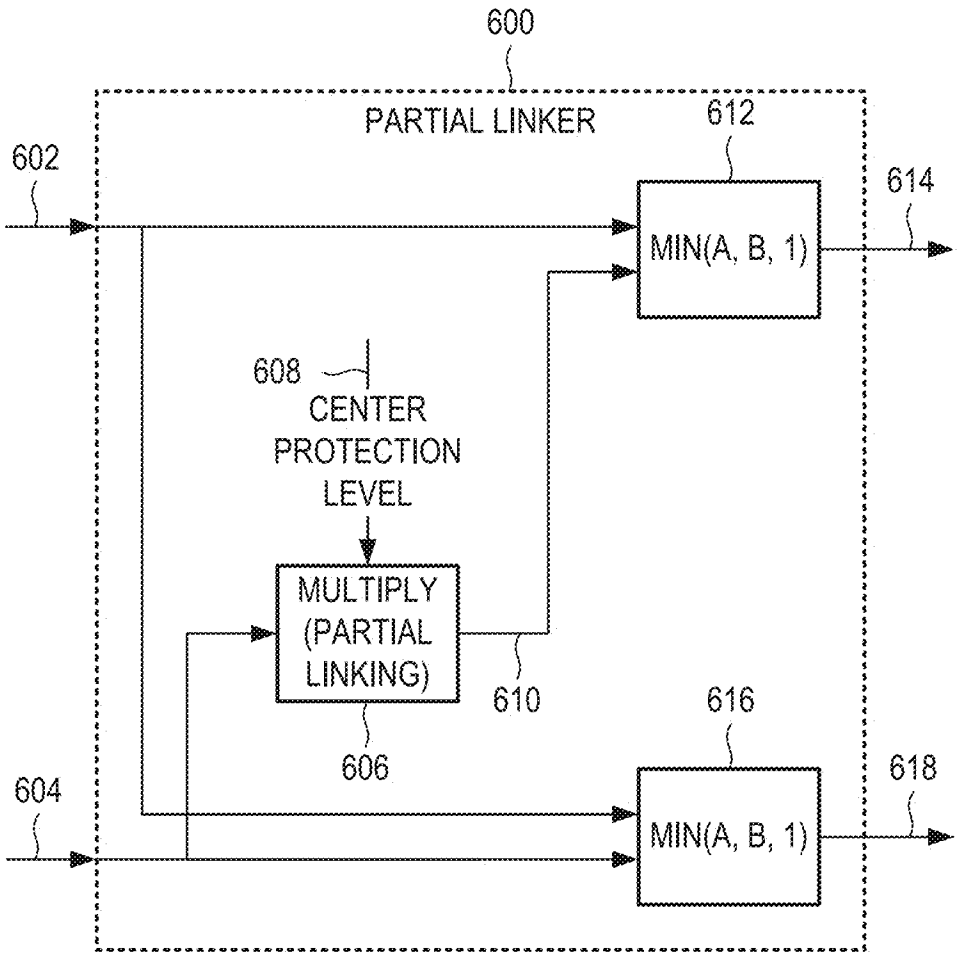
FIG. 6 shows an example of a partial linker, in accordance with some embodiments.

FIG. 6 shows an example of a partial linker 600, in accordance with some embodiments. The partial linker 600 can preserve the panning of center-panned elements in the audio signals, to a degree specified by a user. The partial linker 600 is but one example of an element that can preserve the panning of center-panned elements in the audio signals, to a degree specified by a user; other configurations can also be used.

The partial linker 600 can receive as input a sum gain 602, such as a time-varying sum gain produced by the sum gain calculator 514 of FIG. 5. The partial linker 600 can also receive as input a difference gain 604, such as a time-varying difference gain produced by the difference gain calculator 516 of FIG. 5. Note that the inputs to the partial linker 600 are time-varying gain values, rather than audio signals. In some examples, the inputs to the partial linker 600 can be time-varying volume levels, rather than gain values.

The partial linker 600 can include a multiplier 606 that can multiply the difference gain 604 by a center protection level 608 to produce a center-protected difference gain 610. The center protection level 608 can be a user-defined value, such as one or greater. The center protection level 608 can be static or slowly-varying, in contrast with the audio signals and the time-varying gain levels discussed in this document.

A sum minimum selector 612 can dynamically select a minimum of three values. The first value is the time-varying sum gain 602. The second value is the time-varying center-protected difference gain 610. The third value is a constant, such as unity (1), 100%, or 0 decibels (dB). The sum minimum selector 612 can select the minimum of these three values to form the partially linked sum gain 614 (comparable to 520 in FIG. 5).

A difference minimum selector 616 can dynamically select a minimum of three values. The first value is the time-varying sum gain 602. The second value is the time-varying difference gain 604. The third value is a constant, such as unity (1), 100%, or 0 dB, or another suitable specified value. The difference minimum selector 616 can select the minimum of these three values to form the partially linked difference gain 618 (comparable to 522 in FIG. 5).

In general, a degree of linking between the gains applied to the sum and difference channels can determine how well panning is preserved. For example, if the gains are fully linked (e.g., the gain applied to the sum channel equals the gain applied to the difference channel, and the two gains can vary in time synchronously), then panning can be fully preserved. If the gains are fully unlinked (e.g., the gain applied to the sum channel is completely independent of the gain applied to the difference channel), then undesirable panning can occur, sometimes with sound elements appearing out-of-phase between the left and right channels. The degree of linking can dynamically depend on the relative volume levels of the time-varying sum and difference signals.

When gain reduction is driven by the sum channel energy, the difference gain 604 can be larger than the sum gain 602, the sum gain 602 can pass through to form both the partially linked sum gain 614 and the partially linked difference gain 618. For this case, the sum and difference channels can receive the same time-varying gain, governed by the sum channel energy, which can preserve the phase and lateral panning of the input signal (e.g., preserve spatial stability of the left/right soundstage.)

When gain reduction is driven by the difference channel energy, the sum gain 602 can be larger than the difference gain 604, the center-protected difference gain 610 can pass through to form the partially linked sum gain 614, and the difference gain 604 can pass through to form the partially linked difference gain 618.

If the center protection level 608 is set to unity, then the sum and difference channels receive the same time-varying gain, governed by the difference channel energy, which can preserve the phase and lateral panning of the input signal.

If the center protection level 608 is set higher than unity, then there can be times at which the sum gain 602 is less than the center-protected difference gain 610. At these times, the partially linked sum gain 614 is the sum gain 602, and the partially linked difference gain 618 is the difference gain 604, so that the sum and difference channels are unlinked.

If the center protection level 608 is set higher than unity, then there can also be times at which the sum gain 602 is greater than the center-protected difference gain 610. At these times, the partially linked sum gain 614 is the center-protected difference gain 610, and the partially linked difference gain 618 is the difference gain 604, so that the sum channel can track relative to the difference channel.

In this manner, the partial linker 600 can advantageously link the sum and difference channels when possible, which can preserve the panning of particular sounds in the left/right soundstage.

The partial linker 600 of FIG. 6 is but one example of a partial linker; other suitable configurations can also be used.

Figure 7:
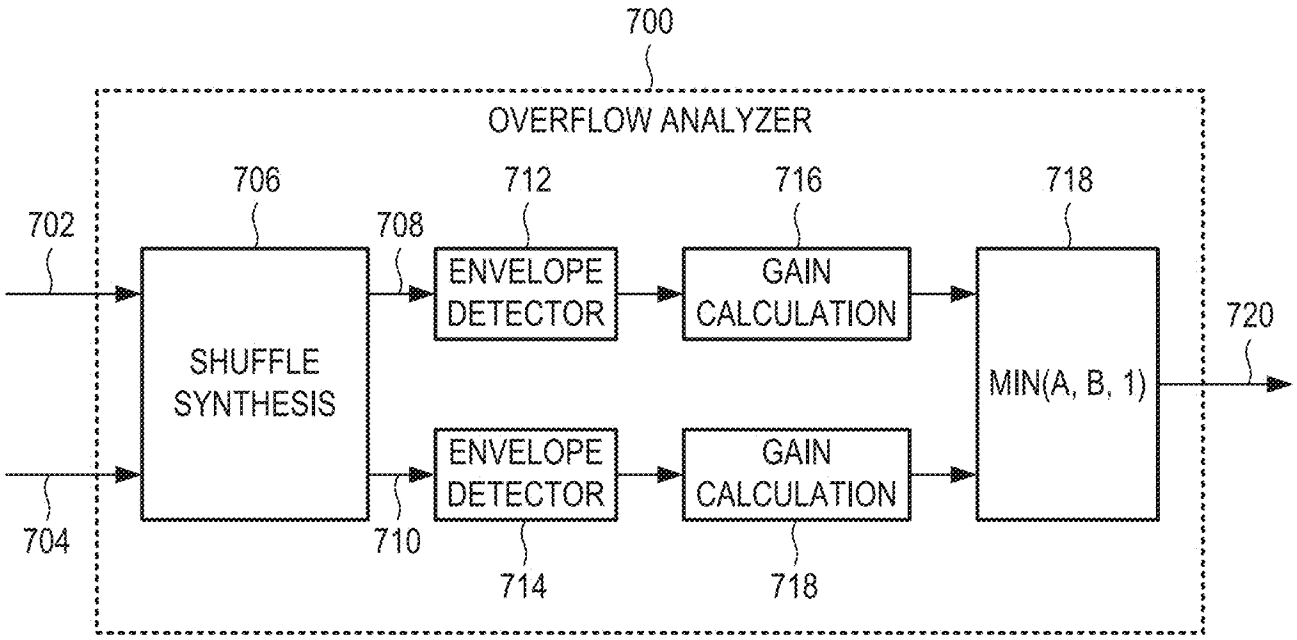
FIG. 7 shows an example of an overflow analyzer, in accordance with some embodiments.

FIG. 7 shows an example of an overflow analyzer 700, in accordance with some embodiments. The overflow analyzer 700 can ensure that after the left and right signals are recreated from the sum and difference signals, the left and right signals do not exceed a specified threshold. The configuration of FIG. 7 is but one example of an overflow analyzer 700; other suitable configurations can also be used.

The overflow analyzer 700 can receive as input a provisional sum signal 702 (comparable to 526 in FIG. 5) and a provisional difference signal 704 (comparable to 530 in FIG. 5).

A synthesizer shuffler 706 can sum the provisional sum signal 702 and the provisional difference signal 704 to form a provisional left signal 708. The synthesizer shuffler 706 can subtract the provisional difference signal 704 from the provisional sum signal 702 to form a provisional right signal 710.

A provisional left envelope detector 712, similar in operation to the envelope detection 320 in FIG. 3, can determine a time-varying volume level for the provisional left signal 708. A provisional right envelope detector 714, also similar in operation to the envelope detection 320 in FIG. 3, can determine a time-varying volume level for the provisional right signal 710. The provisional left envelope detector 712 and the provisional right envelope detector 714 can produce time-varying values of volume level, through peak level detection, RMS level detector, or another suitable measurement technique.

A provisional left gain calculator 716, similar in operation to the gain calculation 322 in FIG. 3, can receive the time-varying value of volume level of the provisional left signal 708 from the provisional left envelope detector 712, and can determine what gain should be applied to a group of samples in the provisional left signal 708 such that after the gain is applied, the provisional left envelope of the samples (determined at 712) does not exceed a specified threshold. In some examples, a user can specify the specified threshold.

A provisional right gain calculator 718, also similar in operation to the gain calculation 322 in FIG. 3, can receive the time-varying value of volume level of the provisional right signal 710 from the provisional right envelope detector 714, and can determine what gain should be applied to a group of samples in the provisional right signal 710 such that after the gain is applied, the difference envelope of the samples (determined at 714) does not exceed a specified threshold, optionally the same threshold as used in the provisional left gain calculator 716. In some examples, the threshold can be a non-unity value that meets the needs of the system.

A provisional minimum selector 718 can dynamically select a minimum of three time-varying values. The first value is the time-varying provisional left signal gain. The second value is the time-varying provisional right signal gain. The third value is a constant, such as unity (1), 100%, 0 dB, or a specified threshold value. The provisional minimum selector 718 can select the minimum of these three values to form the time-varying overflow gain 720 (comparable to 534 in FIG. 5). As an alternative, provisional minimum selector 718 can sequentially select a maximum of the time-varying provisional left signal gain and the time-varying provisional right signal gain, then select a minimum of that selected maximum and a constant, such as unity (1), 100%, 0 dB, or a specified threshold value.

If the gain calculation within the overflow analyzer 700 determines that further attenuation of the provisional sum signal 702 (comparable to 526 in FIG. 5) and a provisional difference signal 704 mid/side short-term gains is needed, the time-varying overflow gain 720 can be incorporated into the sum and difference gains, equally, such as in elements 536 and 542 of FIG. 5.

In the configurations discussed thus far, the systems use shuffler topologies to switch between left/right signals and sum/difference signals. The shufflers generally perform well and have relatively low computational demands. However, more sophisticated techniques exist to extract center channel information from left and right signals. These more complex techniques can decompose a left and right signal into a center signal and a residual signal. In some examples, the residual signal can include a left/right signal pair, as a residual left signal and a residual right signal.

As a specific example, a multi-channel signal can include five channels, including a front center channel, a left channel, a right channel, a surround left channel, and a surround right channel. For each sample in a data stream corresponding to the multi-channel signal, additional signals can be formed from the signals in the five channels. A stereo left channel can be formed as a sum of the left channel, the surround left channel, and a product of a factor $2^{-1/2}$ times the center front channel. A stereo right channel can be formed as a sum of the right channel, the surround right channel, and a product of a factor $2^{-1/2}$ times the center front channel. A center analysis channel can be formed as a sum of a factor $2^{-1/2}$ times the center front channel, one-half of the left channel, and one-half of the right channel. A left analysis channel can be formed as one-half of the left channel, plus the surround left channel, minus one-half of the right channel. A right analysis channel can be formed as one-half of the right channel, plus the surround right channel, minus one-half of the left channel. A center analysis can include a sum (or mid) signal, formed as the left channel plus the right channel, and a difference (or side) signal, formed as the left channel minus the right channel, or, equivalently, the right channel minus the left channel. Synthesis can be accomplished by down-mixing the processed analysis signals. A left stereo output signal can be formed as the center analysis channel plus the left analysis channel. A right stereo output signal can be formed as the center analysis channel plus the right analysis channel. This is but one example; other suitable signal combinations can also be used.

Figure 8:
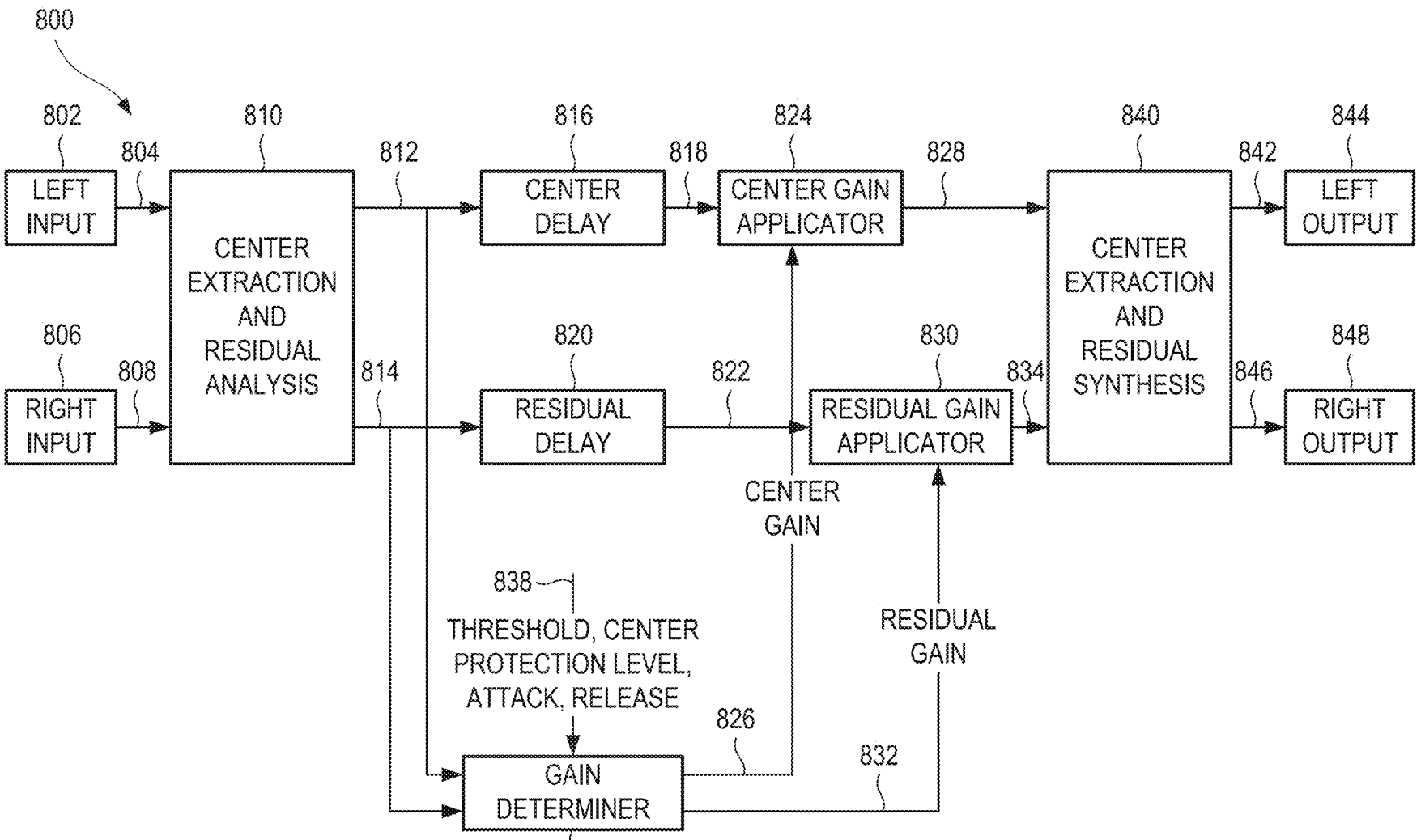
FIG. 8 shows an example of a dynamic range control system in which center extraction and residual analysis can transform left/right signals into center/residual signals and back to left/right signals, in accordance with some embodiments.

FIG. 8 shows an example of a dynamic range control system 800 in which center extraction and residual analysis can transform left/right signals into center/residual signals and back to left/right signals, in accordance with some embodiments. A center gain can be applied to the center signal, and an optionally different residual gain can be applied to the residual signal.

Compared with the system 400 of FIG. 4, the system 800 of FIG. 8 uses center/residual signals, rather than sum/difference signals. Elements 802-848 of FIG. 8 function in a manner similar to corresponding elements 402-448 of FIG. 4, with the substitution of center for sum and residual for difference.

The system 800 can have a left input 802 that can electrically connect to a signal source to receive a left input signal 804, and a right input 806 that can electrically connect to a signal source to receive a right input signal 808. The input and output signals discussed in this document can be analog, digital, or a combination of analog and digital.

The system 800 can employ a center extractor and residual analyzer 810 to convert the left input signal 804 and the right input signal 808 to a center signal 812 and a residual signal 814. In some examples, the residual signal 814 can be a single (channel) signal. In other examples, the residual signal 814 can include a residual left signal and a residual right signal.

To allow the system 800 to look ahead at upcoming frames of audio, the system 800 can include a center channel delay 816 that can delay the center signal 812 to form a delayed center signal 818. Similarly, a residual channel delay 820 can delay the residual signal 814 to form a delayed residual signal 822. The center channel delay 816 and the residual channel delay 820 can delay their respective signals by the same time interval (e.g., the same number of samples or frames.)

A center gain applicator 824 can apply a time-varying center gain 826 to the delayed center signal 818 to produce a limited delayed center signal 828. Similarly, a residual gain applicator 830 can apply a time-varying residual gain 832 to the delayed residual signal 822 to produce a limited delayed residual signal 834.

A gain determiner 836 can determine the time-varying center gain 826 and the time-varying residual gain 832, in response to the center signal 812 and the residual signal 814, and in response to user-specified parameters 838, such as a threshold, an attack time constant, a release time constant, and a center protection level.

A center extractor and residual synthesizer 840 can combine (e.g., add) the limited delayed center signal 828 and the limited delayed residual signal 834 to form a left output signal 842. The left output signal 842 can form a left output 844 of the system 800. The center extractor and residual synthesizer 840 can combine (e.g., subtract) the limited delayed residual signal 834 from the limited delayed center signal 828 to form a right output signal 846. The right output signal 846 can form a right output 848 of the system 800.

Figure 9:
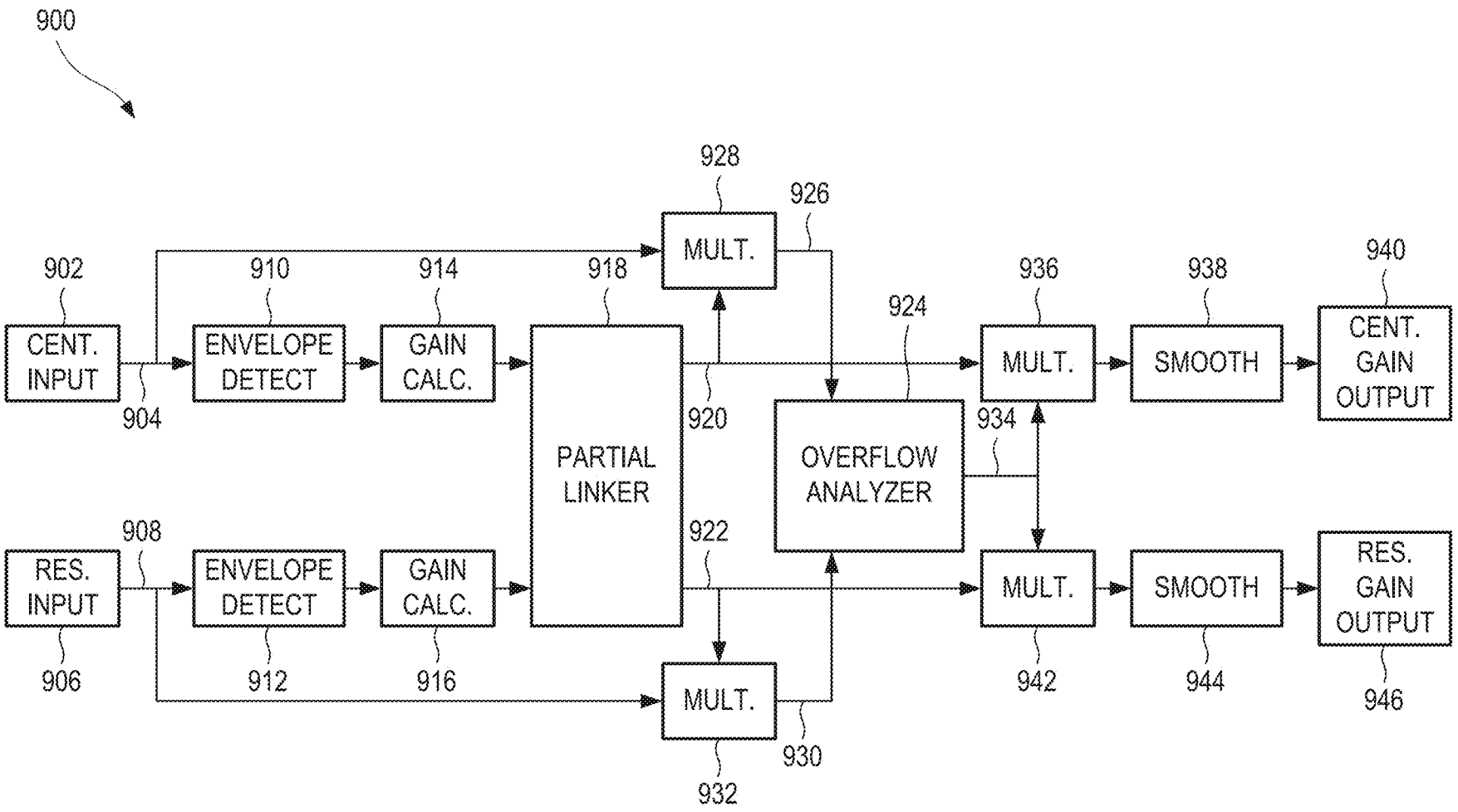
FIG. 9 shows an example of a gain determiner, in accordance with some embodiments.

FIG. 9 shows an example of a gain determiner 900, in accordance with some embodiments. The gain determiner 900 of FIG. 9 is suitable for use in the dynamic range control system 800 of FIG. 8, and for other systems. The gain determiner 900 of FIG. 9 is but one example of a gain determiner; other suitable configurations can also be used.

Compared with the gain determiner 500 of FIG. 5, the gain determiner 900 of FIG. 9 uses center/residual signals, rather than sum/difference signals. Elements 902-946 of FIG. 9 function in a manner similar to corresponding elements 502-546 of FIG. 5, with the substitution of center for sum and residual for residual.

The gain determiner 900 receives as input 902 a center signal 904, such as the center signal 812 shown in FIG. 8. The gain determiner 900 also receives as input 906 a residual signal 908, such as the residual signal 814 shown in FIG. 8.

A center envelope detector 910, similar in operation to the envelope detection 320 in FIG. 3, can determine a time-varying volume level for the center signal 904. A residual envelope detector 912, also similar in operation to the envelope detection 320 in FIG. 3, can determine a time-varying volume level for the residual signal 908. The center envelope detector 910 and the residual envelope detector 912 can produce time-varying values of volume level, through peak level detection, RMS level detector, or another suitable measurement technique.

A center gain calculator 914, similar in operation to the gain calculation 322 in FIG. 3, can receive the time-varying value of volume level of the center signal 904 from the center envelope detector 910, and can determine what gain should be applied to a group of samples in the center signal 904 such that after the gain is applied, the center envelope of the samples (determined at 910) does not exceed a specified threshold. In some examples, a user can specify the specified threshold.

A residual gain calculator 916, also similar in operation to the gain calculation 322 in FIG. 3, can receive the time-varying value of volume level of the residual signal 908 from the residual envelope detector 912, and can determine what gain should be applied to a group of samples in the residual signal 908 such that after the gain is applied, the residual envelope of the samples (determined at 912) does not exceed a specified threshold, optionally the same threshold as used in the center gain calculator 914.

A partial linker 918 can preserve the panning of center-panned elements in the audio signals, in a manner similar to the partial linker 600 of FIG. 6. The partial linker 918 receives as input the center gain from the center gain calculator 914 and the residual gain from the residual gain calculator 916. The partial linker 918 links the center gain and the residual gain, to a degree that can optionally be specified by a user, to form a partially linked center gain 920 and a partially linked residual gain 922.

An overflow analyzer 924 can ensure that after the left and right signals are recreated from the center and residual signals, the left and right signals do not exceed a specified threshold, such as 100%, in a manner similar to the overflow analyzer 700 of FIG. 7. The overflow analyzer 924 receives as input a provisional center signal 926, which is the center signal 904 multiplied (at 928) by the partially linked center gain 920, and a provisional residual signal 930, which is the residual signal 908 multiplied (at 932) by the partially linked residual gain 922. The overflow analyzer 924 can form as its output an overflow gain 934.

The partially linked center gain 920 can be multiplied (at 936) by the overflow gain 934, and smoothed at 938 (similar to 324 of FIG. 3) to form a center gain output 940. The center gain output 940 is one output of the gain determiner 900, comparable to the center gain 826 of FIG. 8.

The partially linked residual gain 922 can be multiplied (at 942) by the overflow gain 934, and smoothed at 944 (similar to 324 of FIG. 3) to form a residual gain output 946. The residual gain output 946 is the other output of the gain determiner 900, comparable to the residual gain 832 of FIG. 8.

The systems 400 of FIG. 4 and 800 of FIG. 8 both used a left input that can electrically connect to a signal source to receive a left input signal, and a right input that can electrically connect to a signal source to receive a right input signal. As an alternative to the explicit left and right signals, one could use a multi-channel source, such as a 5.1-channel mix, a 7.1-channel mix, an 11.1-channel mix, and so forth.

Figure 10:
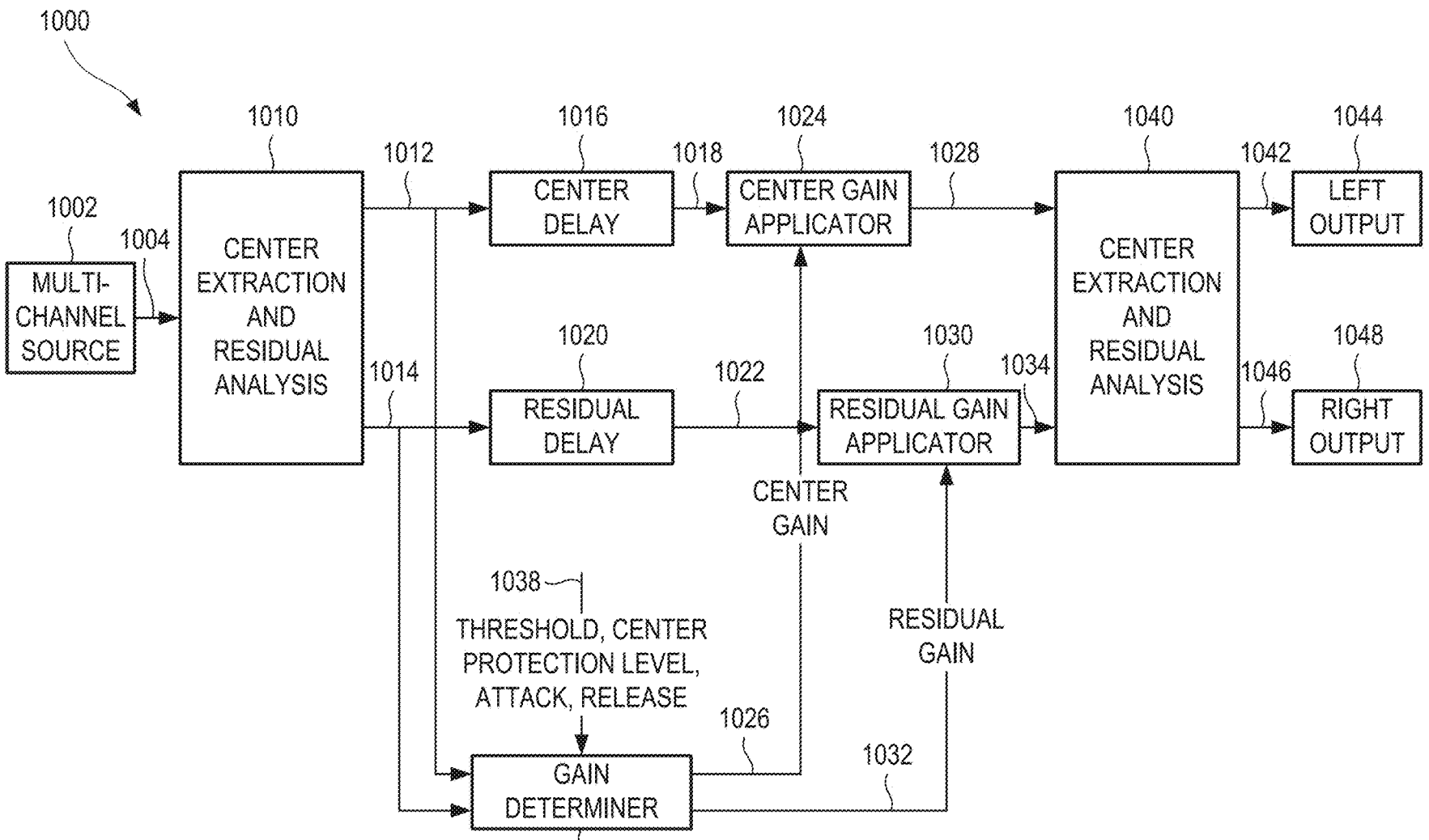
FIG. 10 shows an example of a dynamic range control system in which center extraction and residual analysis can transform multi-channel signals into center/residual signals and then to left/right signals, in accordance with some embodiments.

FIG. 10 shows an example of a dynamic range control system 1000 in which center extraction and residual analysis can transform multi-channel signals into center/residual signals and then to left/right signals, in accordance with some embodiments. A center gain can be applied to the center signal, and an optionally different residual gain can be applied to the residual signal or signals.

Compared with the system 800 of FIG. 8, the system 1000 of FIG. 10 uses a multi-channel source, rather than a left input and a right input. Elements 1010-1048 of FIG. 10 function in a manner similar to corresponding elements 810-848 of FIG. 8, with the substitution of the multi-channel source for the left input and the right input.

The system 1000 can connect with a multi-channel source 1002, which is not necessarily part of the system 1000. The system 1000 can receive a multi-channel input signal 1004. The multi-channel input signal 1004 can be analog, digital, or a combination of analog and digital.

The system 1000 can employ a center extractor and residual analyzer 1010 to convert the multi-channel input signal 1004 to a center signal 1012 and a residual signal 1014. In some examples, the residual signal 1014 can be a single (channel) signal. In other examples, the residual signal 1014 can include a residual left signal and a residual right signal. In still other examples, the residual signal 1014 can include multiple channels, optionally corresponding to the multiple channels in the input signal 1004, minus the center channel.

To allow the system 1000 to look ahead at upcoming frames of audio, the system 1000 can include a center channel delay 1016 that can delay the center signal 1012 to form a delayed center signal 1018. Similarly, a residual channel delay 1020 can delay the residual signal 1014 to form a delayed residual signal 1022. The center channel delay 1016 and the residual channel delay 1020 can delay their respective signals by the same time interval (e.g., the same number of samples or frames.)

A center gain applicator 1024 can apply a time-varying center gain 1026 to the delayed center signal 1018 to produce a limited delayed center signal 1028. Similarly, a residual gain applicator 1030 can apply a time-varying residual gain 1032 to the delayed residual signal 1022 to produce a limited delayed residual signal 1034.

A gain determiner 1036 can determine the time-varying center gain 1026 and the time-varying residual gain 1032, in response to the center signal 1012 and the residual signal 1014, and in response to user-specified parameters 1038, such as a threshold, an attack time constant, a release time constant, and a center protection level. The gain determiner 900 of FIG. 9 is suitable for use with the system 1000; other suitable configurations can also be used.

A center extractor and residual analyzer 1040 can combine (e.g., add) the limited delayed center signal 1028 and the limited delayed residual signal 1034 to form a left output signal 1042. The left output signal 1042 can form a left output 1044 of the system 1000. The center extractor and residual analyzer 1040 can combine (e.g., subtract) the limited delayed residual signal 1034 from the limited delayed center signal 1028 to form a right output signal 1046. The right output signal 1046 can form a tight output 1048 of the system 1000.

Figure 11:
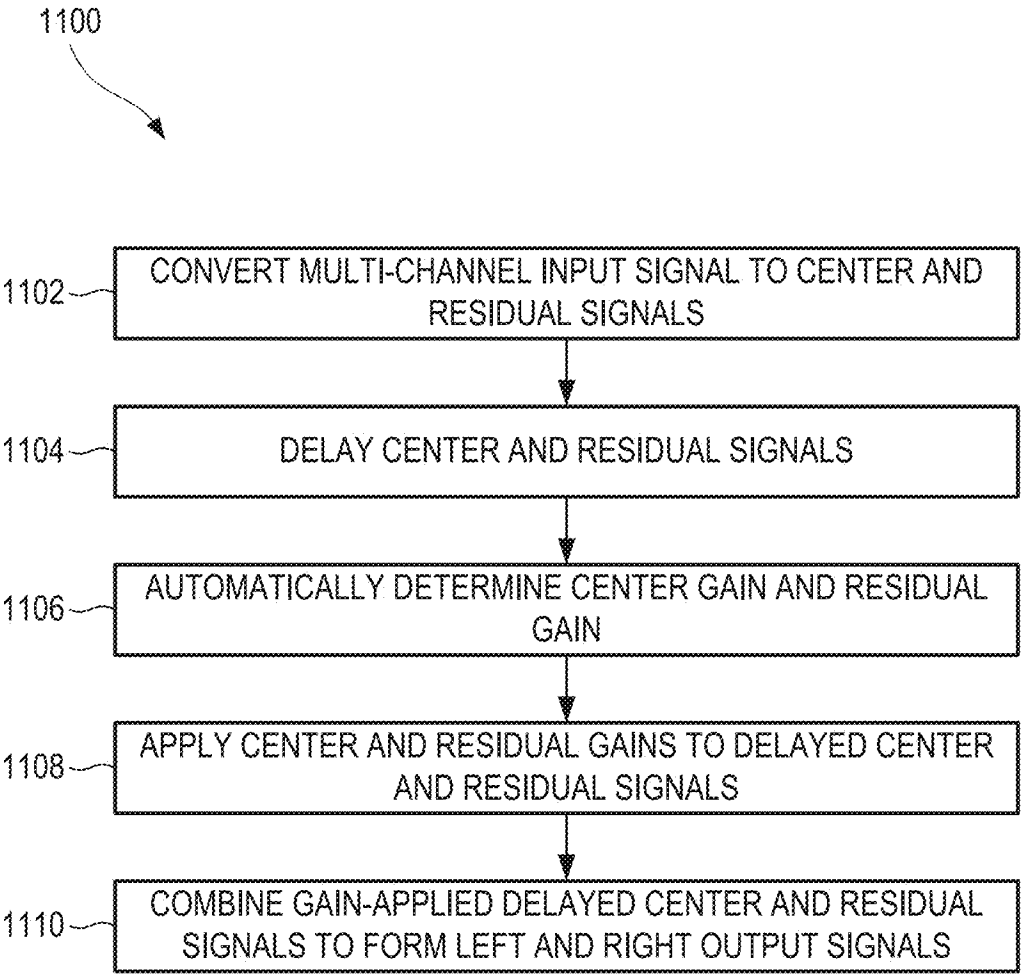
FIG. 11 shows an example of a method for controlling a dynamic range of a multi-channel audio signal, in accordance with some embodiments.

FIG. 11 shows an example of a method 1100 for controlling a dynamic range of a multi-channel audio signal, in accordance with some embodiments. The method 1100 can be executed on any of the systems or system elements shown in FIGS. 1-10, as well as other systems. The method 1100 is but one example of a method for controlling a dynamic range of a multi-channel audio signal; other suitable methods can also be used.

At operation 1102, first center extraction circuitry can convert a multi-channel input signal to a center signal and a residual signal.

At operation 1104, a center channel delay can delay the center signal to form a delayed center signal. Also at operation 1104, a residual channel delay can delay the residual signal to form a delayed residual signal.

At operation 1106, a gain determiner can automatically determine a time-varying center gain and a time-varying residual gain in response to the center signal and the residual signal. The time-varying center gain can vary synchronously with the time-varying residual gain during at least first times. The time-varying center gain can vary independently of the time-varying residual gain during at least second times.

At operation 1108, a center gain applicator can apply the time-varying center gain to the delayed center signal to produce a limited delayed center signal. Also at operation 1108, a residual gain applicator can apply the time-varying residual gain to the delayed residual signal to produce a limited delayed residual signal.

At operation 1110, second center extraction circuitry can combine the limited delayed center signal and the limited delayed residual signal to form the left output signal and the right output signal.

To further illustrate the device and related method disclosed herein, a non-limiting list of examples is provided below. Each of the following non-limiting examples can stand on its own, or can be combined in any permutation or combination with any one or more of the other examples.

In Example 1, a system for processing multi-channel audio can include circuitry configured to separate a multi-channel input signal into a center signal and a residual signal, apply a time-varying center gain to the center signal, apply a time-varying residual gain to the residual signal, and combine the gain-adjusted center and residual signals to form a multi-channel audio signal that includes a left output signal and a right output signal. The circuitry can include a gain determiner configured to automatically determine the time-varying center gain and the time-varying residual gain in response to the center signal and the residual signal so as to prevent the left output signal and the right output signal from exceeding a target volume. The time-varying center gain can vary synchronously with the time-varying residual gain during at least first times so as to ensure that amplitude and phase relationships among channels in the multi-channel input signal are retained into the multi-channel audio signal during the first times. The time-varying center gain can vary independently of the time-varying residual gain during at least second times so as to reduce the energy of the residual signal compared to the center signal in the multi-channel audio signal during the second times.

In Example 2, the system of Example 1 can optionally be configured such that the gain determiner can optionally include: a center envelope detector configured to determine a time-varying volume level for the center signal; a residual envelope detector configured to determine a time-varying volume level for the residual signal; a center gain calculator configured to determine a center gain from the time-varying volume level for the center signal; a residual gain calculator configured to determine a residual gain from the time-varying volume level for the residual signal; a partial linker configured to link the center gain and the residual gain, to a specifiable degree, to form a partially linked center gain and a partially linked residual gain; an overflow analyzer configured to determine an overflow gain to ensure that left output signal and the right output signal do not exceed a maximum volume level; a center channel multiplier and smoother configured to multiply the overflow gain by the partially linked center gain to form a first product and smooth the first product in time to form the time-varying center gain; and a residual channel multiplier and smoother configured to multiply the overflow gain by the partially linked residual gain to form a second product and smooth the second product in time to form the time-varying residual gain.

In Example 3, the system of any one of Examples 1-2 can optionally be configured such that the partial linker is further configured to automatically modify at least one of the center gain or the residual gain such that the center gain and the residual gain vary independently when the time-varying volume levels for the center and residual signals satisfy a first condition and vary synchronously when the time-varying volume levels for the center and residual signals fail to satisfy the first condition.

In Example 4, the system of any one of Examples 1-3 can optionally be configured such that the first condition is when the time-varying volume level for the residual signal exceeds the target volume level and exceeds the time-varying volume level for the center signal.

In Example 5, the system of any one of Examples 1-4 can optionally be configured such that the partial linker is further configured to set the partially linked residual gain to equal a minimum of the group consisting of the center gain, the residual gain, and a maximum correction gain level. In some examples, the maximum correction gain level can equal the target volume level.

In Example 6, the system of any one of Examples 1-5 can optionally be configured such that the partial linker is further configured to set the partially linked center gain to equal a minimum of the group consisting of the center gain, the residual gain multiplied by a center protection level that is greater than or equal to unity, and a maximum correction gain level. In some examples, the maximum correction gain level can equal the target volume level.

In Example 7, the system of any one of Examples 1-6 can optionally be configured such that: when the center protection level is unity, the partially linked center gain and the partially linked residual gain are fully linked, so that the partially linked center gain and the partially linked residual gain vary synchronously; and for increasing values of the center protection level, the requirements loosen under which the partially linked center gain and the partially linked residual gain vary independently.

In Example 8, the system of any one of Examples 1-7 can optionally be configured such that the overflow analyzer comprises: a synthesizer shuffler configured to receive as input a provisional center signal, which is formed as the center signal multiplied by the partially linked center gain, and a provisional residual signal, which is the residual signal multiplied by the partially linked residual gain, the synthesizer shuffler combining the provisional residual signal and the provisional center signal to form a provisional left signal and a provisional right signal; a provisional left envelope detector configured to determine a time-varying volume level for the provisional left signal; a provisional right envelope detector configured to determine a time-varying volume level for the provisional right signal; a provisional left gain calculator configured to determine a provisional left gain from the time-varying volume level for the provisional left signal; a provisional right gain calculator configured to determine a provisional right gain from the time-varying volume level for the provisional right signal; and a provisional minimum selector configured to set the overflow gain to equal a minimum of the group consisting of the provisional left gain, the provisional right gain, and the maximum volume level.

In Example 9, the system of any one of Examples 1-8 can optionally further include: first center extraction circuitry configured to convert the multi-channel input signal to the center signal and the residual signal; a center channel delay configured to delay the center signal to form a delayed center signal; a residual channel delay configured to delay the residual signal to form a delayed residual signal; a center gain applicator configured to apply the time-varying center gain to the delayed center signal to produce a limited delayed center signal; a residual gain applicator configured to apply the time-varying residual gain to the delayed residual signal to produce a limited delayed residual signal; and second center extraction circuitry configured to combine the limited delayed center signal and the limited delayed residual signal to form the left output signal and the right output signal.

In Example 10, the system of any one of Examples 1-9 can optionally be configured such that the multi-channel input signal is a stereo signal that includes a left input signal and a right input signal.

In Example 11, the system of any one of Examples 1-10 can optionally be configured such that: the first center extraction circuitry comprises an analyzer shuffler; the analyzer shuffler is configured to form the center signal as a sum of the left input signal and the right input signal; the analyzer shuffler is configured to form the residual signal as a difference between the left input signal and the right input signal; the second center extraction circuitry comprises a synthesizer shuffler; the synthesizer shuffler is configured to form the left output signal as a sum of the limited delayed center signal and the limited delayed residual signal; and the synthesizer shuffler is configured to form the right output signal as a difference between the limited delayed center signal and the limited delayed residual signal.

In Example 12, the system of any one of Examples 1-11 can optionally be configured such that the center channel delay and the residual channel delay are configured to account for a processing latency of the gain determiner.

In Example 13, a method for processing multi-channel audio can include: converting, with first center extraction circuitry, a multi-channel input signal to a center signal and a residual signal; delaying, with a center channel delay, the center signal to form a delayed center signal; delaying, with a residual channel delay configured to delay the residual signal to form a delayed residual signal; automatically determining, with a gain determiner, a time-varying center gain and a time-varying residual gain in response to the center signal and the residual signal, the time-varying center gain varying synchronously with the time-varying residual gain during at least first times, the time-varying center gain varying independently of the time-varying residual gain during at least second times; applying, with a center gain applicator, the time-varying center gain to the delayed center signal to produce a limited delayed center signal; applying, with a residual gain applicator, the time-varying residual gain to the delayed residual signal to produce a limited delayed residual signal; and combining, with second center extraction circuitry, the limited delayed center signal and the limited delayed residual signal to form the left output signal and the right output signal.

In Example 14, the method of Example 13 can optionally be configured such that automatically determining the time-varying center gain and the time-varying residual gain comprises: determining, with a center envelope detector, a time-varying volume level for the center signal; determining, with a residual envelope detector, a time-varying volume level for the residual signal; determining, with a center gain calculator, a center gain from the time-varying volume level for the center signal; determining, with a residual gain calculator, a residual gain from the time-varying volume level for the residual signal; linking, with a partial linker, the center gain and the residual gain, to a specifiable degree, to form a partially linked center gain and a partially linked residual gain; determining, with an overflow analyzer, an overflow gain to ensure that left output signal and the right output signal do not exceed a maximum volume level;

multiplying, with a center channel multiplier, the overflow gain by the partially linked center gain to form a first product; smoothing, with a center channel smoother, the first product in time to form the time-varying center gain; multiplying, with a residual channel multiplier, the overflow gain by the partially linked residual gain to form a second product; and smoothing, with a residual channel smoother, the second product in time to form the time-varying residual gain.

In Example 15, the method of any one of Examples 13-14 can optionally be configured such that linking the center gain and the residual gain comprises setting the partially linked residual gain to equal a minimum of the group consisting of the center gain, the residual gain, and the maximum volume level.

In Example 16, the method of any one of Examples 13-15 can optionally be configured such that linking the center gain and the residual gain comprises setting the partially linked center gain to equal a minimum of the group consisting of the center gain, the residual gain multiplied by a center protection level that is greater than or equal to unity, and the maximum volume level.

In Example 17, the method of any one of Examples 13-16 can optionally be configured such that: when the center protection level is unity, the partially linked center gain and the partially linked residual gain are fully linked, so that the partially linked center gain and the partially linked residual gain vary synchronously; and for increasing values of the center protection level, the requirements loosen under which the partially linked center gain and the partially linked residual gain vary independently.

In Example 18, the method of any one of Examples 13-17 can optionally be configured such that determining the overflow gain comprises: receiving as input a provisional center signal, which is formed as the center signal multiplied by the partially linked center gain, and a provisional residual signal, which is the residual signal multiplied by the partially linked residual gain; combining the provisional residual signal and the provisional center signal to form a provisional left signal and a provisional right signal; determining a time-varying volume level for the provisional left signal; determining a time-varying volume level for the provisional right signal; determining a provisional left gain from the time-varying volume level for the provisional left signal; determining a provisional right gain from the time-varying volume level for the provisional right signal; and setting the overflow gain to equal a minimum of the group consisting of the provisional left gain, the provisional right gain, and the maximum volume level.

In Example 19, a system for processing multi-channel audio can include: first center extraction circuitry configured to convert a multi-channel input signal to a center signal and a residual signal; a center channel delay configured to delay the center signal to form a delayed center signal; a residual channel delay configured to delay the residual signal to form a delayed residual signal; a gain determiner configured to automatically determine a time-varying center gain and a time-varying residual gain in response to the center signal and the residual signal, the time-varying center gain varying synchronously with the time-varying residual gain during at least first times, the time-varying center gain varying independently of the time-varying residual gain during at least second times; a center gain applicator configured to apply the time-varying center gain to the delayed center signal to produce a limited delayed center signal; a residual gain applicator configured to apply the time-varying residual gain to the delayed residual signal to produce a limited delayed residual signal; and second center extraction circuitry configured to combine the limited delayed center signal and the limited delayed residual signal to form the left output signal and the right output signal.

In Example 20, the system of claim 19 can optionally be configured such that the gain determiner comprises: a center envelope detector configured to determine a time-varying volume level for the center signal; a residual envelope detector configured to determine a time-varying volume level for the residual signal; a center gain calculator configured to determine a center gain from the time-varying volume level for the center signal; a residual gain calculator configured to determine a residual gain from the time-varying volume level for the residual signal; a partial linker configured to link the center gain and the residual gain, to a specifiable degree, to form a partially linked center gain and a partially linked residual gain; an overflow analyzer configured to determine an overflow gain to ensure that left output signal and the right output signal do not exceed a maximum volume level; a center channel multiplier and smoother configured to multiply the overflow gain by the partially linked center gain to form a first product and smooth the first product in time to form the time-varying center gain; and a residual channel multiplier and smoother configured to multiply the overflow gain by the partially linked residual gain to form a second product and smooth the second product in time to form the time-varying residual gain.

Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by circuitry that can include one or more processors, a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the system and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other micro-controller, or can be conventional central processing units (CPUs) having one or more processing cores, including specialized graphics processing unit (GPU)-based cores in a multi-core CPU.

The process actions or operations of a method, process, or algorithm described in connection with the embodiments of the automatic room acoustics correction system and method disclosed herein can be embodied directly in hardware, in a software module executed by a processor, or in any combination of the two. The software module can be contained in computer-readable media that can be accessed by a computing device. The computer-readable media includes both volatile and nonvolatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Bluray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CD-ROM, or any other form of non-transitory computer-readable storage medium, media, or physical computer storage known in the art. In some examples, a storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or long-lived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

The phrase "audio signal" is a signal that is representative of a physical sound.

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the automatic room acoustics correction system and method described herein, or portions thereof, may be stored, received, transmitted, or read from any desired combination of computer or machine-readable media or storage devices and communication media in the form of computer executable instructions or other data structures.

Embodiments of the system and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the scope of the disclosure. As will be recognized, certain embodiments of the system and method described herein can be embodied within a form that does not provide all of the features and benefits set forth herein, as some features can be used or practiced separately from others.

What is claimed is:

1. A system for processing multi-channel audio, the system comprising:

circuitry configured to separate a multi-channel input signal into a center signal and a residual signal, apply a time-varying center gain to the center signal, apply a time-varying residual gain to the residual signal, and combine the gain-adjusted center and residual signals to form a multi-channel audio signal that includes a left output signal and a right output signal, the circuitry including a gain determiner configured to automatically determine the time-varying center gain and the time-varying residual gain in response to the center signal and the residual signal so as to prevent the left output signal and the right output signal from exceeding a target volume.

2. The system of claim 1, wherein the gain determiner is configured to vary the time-varying center gain synchronously with the time-varying residual gain during at least first times so as to ensure that amplitude and phase relationships among channels in the multi-channel input signal are retained into the multi-channel audio signal during the first times.

3. The system of claim 1, wherein the gain determiner is configured to vary the time-varying center gain independently of the time-varying residual gain during at least second times so as to reduce the energy of the residual signal compared to the center signal in the multi-channel audio signal during the second times.

4. The system of claim 1, wherein the gain determiner comprises:

a center envelope detector configured to determine a time-varying volume level for the center signal;

a residual envelope detector configured to determine a time-varying volume level for the residual signal;

a center gain calculator configured to determine a center gain from the time-varying volume level for the center signal;

a residual gain calculator configured to determine a residual gain from the time-varying volume level for the residual signal;

a partial linker configured to link the center gain and the residual gain, to a specifiable degree, to form a partially linked center gain and a partially linked residual gain;

an overflow analyzer configured to determine an overflow gain to ensure that t left output signal and the right output signal do not exceed a target volume level;

a center channel multiplier and smoother configured to multiply the overflow gain by the partially linked center gain to form a first product and smooth the first product in time to form the time-varying center gain; and a residual channel multiplier and smoother configured to multiply the overflow gain by the partially linked residual gain to form a second product and smooth the second product in time to form the time-varying residual gain.

5. The system of claim 4, wherein the partial linker is further configured to automatically modify at least one of the center gain or the residual gain such that the center gain and the residual gain vary independently when the time-varying volume levels for the center and residual signals satisfy a first condition and vary synchronously when the time-varying volume levels for the center and residual signals fail to satisfy the first condition.

6. The system of claim 5, wherein the first condition is when the time-varying volume level for the residual signal exceeds the target volume level and exceeds the time-varying volume level for the center signal.

7. The system of claim 4, wherein the partial linker is further configured to set the partially linked residual gain to equal a minimum of the group consisting of the center gain, the residual gain, and a maximum correction gain level.

8. The system of claim 4, wherein the partial linker is further configured to set the partially linked center gain to equal a minimum of the group consisting of the center gain, the residual gain multiplied by a center protection level that is greater than or equal to unity, and a maximum correction gain level.

9. The system of claim 8, wherein:

when the center protection level is unity, the partially linked center gain and the partially linked residual gain are fully linked, so that the partially linked center gain and the partially linked residual gain vary synchronously; and for increasing values of the center protection level, the requirements loosen under which the partially linked center gain and the partially linked residual gain vary independently.

10. The system of claim 4, wherein the overflow analyzer comprises:

a synthesizer shuffler configured to receive as input a provisional center signal, which is formed as the center signal multiplied by the partially linked center gain, and a provisional residual signal, which is the residual signal multiplied by the partially linked residual gain, the synthesizer shuffler combining the provisional residual signal and the provisional center signal to form a provisional left signal and a provisional right signal;

a provisional left envelope detector configured to determine a time-varying volume level for the provisional left signal;

a provisional right envelope detector configured to determine a tune-varying volume level for provisional right signal;

a provisional left gain calculator configured to determine a provisional left gain from the time-varying volume level for the provisional left signal;

a provisional right gain calculator configured to determine a provisional right gain from the time-varying volume level for the provisional right signal; and a provisional minimum selector configured to set the overflow gain to equal a minimum of the group consisting of the provisional left gain, the provisional right gain, and the target volume level.

11. The system of claim 1, further comprising:

first center extraction circuitry configured to convert the multi-channel input signal to the center signal and the residual signal;

a center channel delay configured to delay the center signal to form a delayed center signal;

a residual channel delay configured to delay the residual signal to form a delayed residual signal;

a center gain applicator configured to apply the time-varying center gain to the delayed center signal to produce a limited delayed center signal;

a residual gain applicator configured to apply the time-varying residual gain to the delayed residual signal to produce a limited delayed residual signal; and second center extraction circuitry configured to combine the limited delayed center signal and the limited delayed residual signal to form the left output signal and the right output signal.

12. The system of claim 11, wherein the center channel delay and the residual channel delay are configured to account for a processing latency of the gain determiner.

13. The system of claim 1, wherein the multi-channel input signal is a stereo signal that includes a left input signal and a right input signal.

14. The system of claim 13, wherein:

the first center extraction circuitry comprises an analyzer shuffler;

the analyzer shuffler is configured to form the center signal as a sum of the left input signal and the right input signal;

the analyzer shuffler is configured to form the residual signal as a difference between the left input signal and the right input signal;

the second center extraction circuitry comprises a synthesizer shuffler;

the synthesizer shuffler is configured to form the left output signal as a sum of the limited delayed center signal and the limited delayed residual signal; and the synthesizer shuffler is configured to form the right output signal as a difference between the limited delayed center signal and the limited delayed residual signal.

15. A method for processing multi-channel audio, the method comprising:

converting, with first center extraction circuitry, a multi-channel input signal to a center signal and a residual signal;

delaying, with a center channel delay, the center signal to form a delayed center signal;

delaying, with a residual channel delay configured to delay the residual signal to form a delayed residual signal;

automatically determining, with a gain determiner, a time-varying center gain and a time-varying residual gain in response to the center signal and the residual signal;

applying, with a center gain applicator, the time-varying center gain to the delayed center signal to produce a limited delayed center signal;

applying, with a residual gain applicator, the time-varying residual gain to be delayed residual signal to produce a limited delayed residual signal; and combining, with second center extraction circuitry, the limited delayed center signal and the limited delayed residual signal to form the left output signal and the right output signal.

16. The method of claim 15, wherein the gain determiner automatically determines the time-varying center gain and the time-varying residual gain such that the time-varying center gain varies synchronously with the time-varying residual gain during at least first times, and the time-varying center gain varies independently of the time-varying residual gain during at least second times.

17. The method of claim 15, wherein automatically determining the time-varying center gain and the time-varying residual gain comprises:

determining, with a center envelope detector, a time-varying volume level for the center signal;

determining, with a residual envelope detector, a time-varying volume level for the residual signal;

determining, with a center gain calculator, a center gain from the time-varying volume level for the center signal;

determining, with a residual gain calculator, a residual gain from the time-varying volume level for the residual signal;

linking, with a partial linker, the center gain and the residual gain, to a specifiable degree, to form a partially linked center gain and a partially linked residual gain;

determining, with an overflow analyzer, an overflow gain to ensure that left output signal and the right output signal do not exceed a target volume level;

multiplying, with a center channel multiplier, the overflow gain by the partially linked center gain to form a first product;

smoothing, with a center channel smoother, the first product in time to form the time-varying center gain;

multiplying, with a residual channel multiplier, the overt ow gain by the partially linked residual gain to form a second product; and smoothing, with a residual channel smoother, the second product in time to form the time-varying residual gain.

18. A system for processing multi-channel audio, the system comprising:

a processor configured to:

convert a multi-channel input signal to a center signal and a residual signal;

delay the center signal to form a delayed center signal;

delay the residual signal to form a delayed residual signal;

automatically determine a time-varying center gain and a time-varying residual gain in response to the center signal and the residual signal;

apply the time-varying center gain to the delayed center signal to produce a limited delayed center signal;

apply the time-varying residual gain to the delayed residual signal to produce a limited delayed residual signal; and combine the limited delayed center signal and the limited delayed residual signal to form the left output signal and the right output signal.

19. The system of claim 18, wherein the processor is further configured to vary the time-varying center gain synchronously with the time-varying residual gain during at least first times.

20. The system of claim 18, wherein the processor is further configured to vary the time-varying center gain independently of the time-varying residual gain during at least second times.

* * * * *